United States Patent [19]

Blixt et al.

[11] Patent Number: 4,964,915

[45] Date of Patent: Oct. 23, 1990

[54] SIZING COMPOSITION, A METHOD FOR THE PREPARATION THEREOF AND A METHOD OF USE

[75] Inventors: Tony Blixt, Helsingborg; Philip Hakansson, Solvesborg, both of Sweden

[73] Assignee: W. R. Grace & Co.-Conn., New York, N.Y.

[21] Appl. No.: 364,049

[22] Filed: Jun. 8, 1989

[30] Foreign Application Priority Data

Jun. 22, 1988 [SE] Sweden ..... 8802355

[51] Int. Cl.[5] ..... C09D 103/02; C09D 103/12; D21H 19/12

[52] U.S. Cl. ..... 106/210; 162/175

[58] Field of Search ..... 106/210, 211; 162/158, 162/175

[56] References Cited

U.S. PATENT DOCUMENTS

| | | | |
|---|---|---|---|
| 2,461,139 | 2/1949 | Caldwell | 106/210 |
| 3,130,118 | 4/1964 | Chapman | 162/175 |
| 3,223,544 | 12/1965 | Savina | 106/213 |
| 4,240,935 | 12/1980 | Dumas | 260/9 |
| 4,317,756 | 3/1982 | Dumas | 524/607 |
| 4,382,129 | 5/1983 | Bankert | 524/598 |
| 4,629,655 | 12/1986 | Winters et al. | 162/158 |

FOREIGN PATENT DOCUMENTS

| | | |
|---|---|---|
| 5451459 | 5/1960 | Australia . |
| 63-941/60 | 8/1962 | Australia . |
| 8090/61 | 5/1963 | Australia . |
| 17613/62 | 11/1963 | Australia . |
| A0228576 | 7/1987 | European Pat. Off. . |
| 963487 | 7/1964 | United Kingdom . |
| 1122182 | 7/1968 | United Kingdom . |

*Primary Examiner*—William R. Dixon, Jr.
*Assistant Examiner*—David M. Brunsman
*Attorney, Agent, or Firm*—James P. Barr

[57] ABSTRACT

The present invention relates to a novel sizing composition in the form of an aqueous emulsion comprising a hydrophobic cellulose reactive sizing agent and a cationic polymer comprising a starch, the novel features of said composition being that the starch possesses a combination of (A) a branched, high molecular weight structure as reflected by an amylopectin content of at least 85% and (B) a degree of substitution of about 0.045 to 0.40.

Such sizing compositions can be prepared by dissolving the aforementioned starch in water, adjusting the temperature to above the melting point of the sizing agent and adding the sizing agent to the solution so as to form a coarse emulsion, which is subsequently subjected to shear forces to reduce the particle size of the emulsion. The invention also relates to a method of preparing sized paper or paperboard by using the abovementioned sizing composition. Also, the invention relates to the sized paper for paperboard prepared by said method. Such paper products show reduction in liquid absorbency as compared to products using conventional sizing agents, reduced comsumption of optical highteners, and enhanced development of sizing.

11 Claims, No Drawings

SIZING COMPOSITION, A METHOD FOR THE PREPARATION THEREOF AND A METHOD OF USE

TECHNICAL FIELD

The present invention relates to a novel composition which is useful as a sizing composition in connection with the manufacture of paper, paperboard and similar products. The invention also relates to a process for the preparation of this sizing composition as well as to a use thereof, viz. in a method of preparing sized paper or paperboard. Finally, the invention relates to the sized paper or paperboard prepared by this method.

More specifically the invention relates to a composition in the form of an aqueous emulsion comprising a hydrophobic cellulose-reactive sizing agent and a cationic polymer comprising a starch. Aqueous emulsions of this type are previously known per se but the present invention relates to an improved sizing composition by which many of the disadvantages of the previously known sizing compositions are eliminated or greatly reduced, as will be described below. The major novel features of the composition claimed reside in the use of a novel cationic starch having a specific combination of chemical characteristics.

BACKGROUND OF THE INVENTION

For the preparation of certain paper gradés, there is a need for counteracting or inhibiting the natural liquid-absorbing properties of paper. Examples of such paper grades are writing paper and printing paper. Other examples are board or paperboard intended for juice and milk cartons. Still another example is photobase paper.

Paper grades such as the aforementioned require liquid-repellent properties. There are many different methods available for achieving liquid repellancy, (i.e. hydrophobicity or sizing). One of these is to add during the paper manufacturing process an emulsion of a hydrophobic material. Many different hydrophobic materials can be utilized. Among the most effective are the so called hydrophobic cellulose-reactive sizing agents. It is believed that when using this type of agent, sizing is obtained by a reaction between the hydrophobic material and the hydroxyl groups of the cellulose. Examples of typical hydrophobic sizing agents are alkylketene dimers, alkenyl succinic anhydrides and fatty isocyanates.

Since the hydrophobic sizing agents are insoluble in water they are employed in the paper manufacturing process in the form of an emulsion. As emulsifiers surfactants may be utilized, but in general surfactants give emulsions having a poor effectiveness as they show a low affinity to the cellulose fiber, which in turn means that much of the hydrophobic sizing agent will be lost when dewatering the paper stock. It has been found that cationic polymers are comparatively better emulsifying agents. Examples of cationic polymers employed for this purpose are described in U.S. Pat. No. 3,130,118 which discloses the use of a cationic starch as an emulsifying agent, and U.S. Pat. No. 4,240,935 which emphasizes the advantages of using as emulsifying agents resins comprising the reaction product of epichlorohydrin and an aminopolyamide prepared from adipic acid and diethylene triamine.

In hydrophobic sizing compositions, the cationic polymer desirably fulfills many functions. Firstly it should stabilize the emulsions. Secondly it should enhance retention of the hydrophobic or sizing agent, either alone or in combination with a separately added retention agent on the paper. Furthermore, the choice of emulsifier may influence the degree of sizing so as to enable the manufacture of a more hydrophobic paper. U.S. Pat. No. 4,382,129 discloses a cationic polymer having this property. Moreover, it has been found that certain cationic polymers may enhance the rate of sizing which is developed over time with the cellulose-reactive sizing agents. U.S. Pat. No. 4,317,756 discloses polymers having such an effect.

For each of these different effects it is very difficult or unreliable to predict how a given cationic polymer will act or work and in general this is completely impossible, as it has not been shown or proved how the choice of cationic polymer affects the total efficiency of the combination of hydrophobic cellulose-reactive sizing agent and cationic polymer. In spite of the fact that hydrophobic cellulose-reactive sizing agents have been available on the market for more than 20 years and that during said years the products have been considerably improved, there are still improvements to be achieved in this art. Comparatively large amounts of cellulose-reactive sizing agents have to be used to obtain the desired liquid repellancy with the hydrophobic sizing compositions of the prior art. A reduction of the amount of sizing agent to be used to obtain the necessary degree of sizing would mean great savings in material costs. In addition, hydrophobic cellulose-reactive sizing agents do not give an immediate sizing. Such an action can be accelerated by the use of a combination of certain types of cationic polymers as have been previously described, but unfortunately these strongly cationic polymers have the disadvantage that they considerably impair the effectiveness of optical brighteners used to improve the whiteness of the paper, resulting in increased consumption of optical brighteners. This sets limits to the machine speed for certain high whiteness grades of paper as a certain minimum degree of sizing must have been obtained when the paper passes the size press or an on-line coating unit, as otherwise the paper will be very weak and will easily rupture. For certain paper grades, it would be desirable to reach a higher degree of sizing than is technically obtainable today. This applies for instance to milk and juice paper boards and to photobase papers.

GENERAL DESCRIPTION OF THE INVENTION

In accordance with the present invention, it has unexpectedly been found that a certain type of cationic starch in combination with a hydrophobic cellulose-reactive sizing agent gives effects which considerably improve or eliminate many of the deficiencies of the prior art. It has also surprisingly been shown that the negative effects on optical brighteners resulting from the use of many of the prior art sizing agents are considerably reduced by the sizing compositions of this invention as compared with conventional hydrophobic cellulose-reactive sizing agents both with and without any added cationic polymer.

Thus, a principal object of the invention is the provision of a new and improved composition which can be used for the sizing of paper, paperboard and similar products.

Another object of the invention is the provision of a new sizing composition which is more efficient than prior art compositions in that reduced amounts of the sizing agent are needed to obtain a degree of sizing similar to that of previously known compositions.

Still another object of the invention is the provision of a new sizing composition, the sizing action of which is more rapid than that of prior art compositions.

A further object of the invention is the provision of a new sizing composition that can be used to obtain higher degrees of sizing than is today possible.

A still further object of the invention is the provision of a new sizing composition, for which the negative effects on optical brightener consumption has been reduced as compared to prior art sizing compositions.

A further object of the invention is the provision of a new sizing composition which will give a dispersion having an outstanding stability.

A still further object of the invention is the provision of a new sizing composition that can be used to obtain better printing and copying characteristics of the paper, i.e. an improved adhesion of toner ink at photocopying.

Another object of the invention is the provision of a new process for the preparation of a sizing composition as disclosed above.

Still another object of the invention is the provision of an improved method of preparing sized paper or paperboard which utilizes the new sizing compositions according to the invention.

A still further object of the invention is the provision of sized paper or sized paperboard having improved properties due to the use of the novel sizing composition herein disclosed.

In accordance with the invention, these and other objects are accomplished by the provision of a sizing composition in the form of an aqueous emulsion comprising a hydrophobic cellulose-reactive sizing agent and a cationic polymer comprising a starch, the novel characteristic features of the composition being that the starch possesses a combination of (A) a highly branched, high molecular weight structure, as indicated by an amylopectin content of at least 85% and (B) a degree of cationization or degree of substitution (D.S.) of 0.045 to 0.4.

Thus, the type of cationic starch which has unexpectedly turned out to impart to the paper the above-mentioned outstanding properties is a starch that is essentially of the so-called amylopectin type and has a certain critical degree of cationization. As is well known to those skilled in the art, most starches contain two types of glucose polymers, amylose and amylopectin. Amylose is a linear, low molecular weight glucose polymer having an average degree of polymerization of about 800 for corn starch, for example, and about 3000 for potato and tapioca starch. Amylopectin, in contast, is a branched, high molecular weight starch fraction having an average degree of polymerization about 500 to 3000 times as high as the degree of polymerization of amylose.

As a result of their branched structure and high degree of polymerization, starches of the so-called amylopectin type, i.e. those having an amylopectin content (amylose content +amylopectin content =100%) of at least 85% by weight, are inherently high molecular weight, having number average molecular weights of about 200,000,000 to 400,000,000. For example, corn and wheat starch, having amylopectin contents of about 72% have a number average molecular weight (degree of polymerization x 162) of about 500,000. In contrast, waxy maize starch having an amylopectin content of about 99–100% has a number average weight of about 320,000,000.

Starches having a high degree of the amylose type of starch, i.e. linear, low molecular weight starches, do not yield the advantages of the starches used in this invention, regardless of the degree of cationization. Nor do starches which essentially consist of the amylopectin type of starch but which have a low degree of cationization give similar effects. The amount of amylopectin and amylose present in a starch is determined by its origin. Thus, by way of example, potato starch contains naturally approximately 79% of amylopectin, while corn starch contains naturally approximately 72% of amylopectin and wheat starch contains naturally approximately 72% of amylopectin. The content of amylopectin can be increased by fractioning the starch. Preferably, a starch having naturally a high content of amylopectin can be used, such waxy maize starch having as much as 99 to 100% of amylopectin. It is also possible to mix starches of different origins to obtain a ratio of amylose to amylopectin within the scope of the invention.

As to the upper limit of amylopectin present in the starch, this limit may reach 100%, although it may be difficult in practice to reach such a high amylopectin content. However, as was mentioned above, so called waxy maize starch containing about 99% of amylopectin has been found especially suitable in accordance with the invention. In general the content of amylopectin in the starch should be as high as possible, at least 85%, more preferably about 90–100%, and most preferably about 95–100%, e.g., approximately 99% as found in waxy maize starch.

The degree of cationization of the starch can be characterized by means of the degree of substitution (D. S. value), which is a conventional way of characterizing a starch.

Cationized starches as used herein can schematically be represented by the formula:

R (cationic function)$_n$ where R is the monosaccharide unit of the starch, and n represents the D.S. value. A saccharide unit has three hydroxyl groups, so that the highest theoretical D.S. value for a cationic starch is 3. Thus, theoretically the D.S. value may be any value between 0 and 3 for a cationic starch. However, as was mentioned above, in accordance with the present invention it has unexpectedly been found that in combination with a cellulose-reactive sizing agent the starch which has unexpectedly turned out to give outstanding results is a starch having a D.S. value in the range of about 0.045–0.40. Generally a preferred degree of substitution is within the range of about 0.05 to 0.20, more preferably from about 0.06 to 0.20, and even more preferably, from about 0.05 to 0.1, e.g. 0.07.

The ratio or proportions between the cellulose-reactive sizing agent and the cationic starch employed herein is of course determined by the skilled artisan for each and every case while taking into consideration the properties which are required or desired in the particular situation. A preferred ratio of cellulose-reactive sizing agent:cationic starch for most sizing agents is, however, within the range of about 1:0.02 to 1:2, a range of about 1:0.05 to 1:0.5 being especially preferred. With the cyclic dicarboxylic anhydrides, such as alkyl succinic anhydride, ratios of about 1:0.01 to 1:5 may be used.

The choice of hydrophobic cellulose-reactive sizing agent, is made among the previously known sizing agents of the type in accordance with prior art teachings, e.g., disclosed in U. S. Pat. No. 3,130,118, for example, the entirety of which is hereby incorporated by reference and relied on in its entirety.

Especially advantageous sizing agents for use in combination with the new starch in accordance with the invention are selected from the group consisting of:

(a) acid anhydrides of the formula:

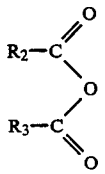

where $R_2$ and $R_3$ are the same or different and each represent hydrocarbon radicals containing 7–30 carbon atoms;

(b) cyclic dicarboxylic anhydrides of the formula:

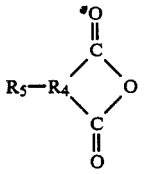

where $R_4$ contains 2 or 3 carbon atoms and $R_5$ is a hydrocarbon radical having 7–30 carbon atoms;

(c) ketene dimers of the formula:

$(R_6CH{=}C{=}O)_2$ where $R_6$ is a hydrocarbon radical having 6–30 carbon atoms, preferably alkyl having 6–22 carbon atoms; and (d) isocyanates of the formula:

$R_7{-}N{=}C{=}O$ where $R_7$ is a hydrocarbon radical having 7–30 carbon atoms.

A preferred embodiment of the acid anhydrides referred to in section (a) is a stearyl anhydride, while a specific example of a suitable cyclic dicarboxylic anhydride from section (b) is isooctadekenyl succinic anhydride. As to the ketene dimers of section (c), cyclo alkyl and aryl radicals are also useful as said hydrocarbon radical, although a saturated radical such as an alkyl radical is most preferred as indicated.

Of the above mentioned four groups (a)-(d), of cellulose-reactive agents, the cyclic dicarboxylic anhydrides of section (b) and the ketene dimers of section (c) are most preferred, the ketene dimers being especially preferred.

Preferably the hydrocarbon radicals $R_2$, $R_3$, $R_6$ and $R_7$ are saturated, linear chain radicals which may, however, contain unsaturation and cyclic or aromatic substituents. $R_5$ preferably is a saturated linear chain or branched alkyl radical. Further, $R_2$, $R_3$, $R_6$ and $R_7$ should preferably have 14–22 carbon atoms, and R5 should preferably have 14–30 carbon atoms. The hydrocarbon groups $R_2$, $R_3$, $R_4$, $R_5$, $R_6$, and $R_7$ in each of the above formulae may also be substituted, e.g., with halogen, for example chlorine, where a special effect is desired.

The sizing compositions according to the invention can optionally contain additional conventional ingredients, known to be useful in sizing compositions of the present type. Examples of common additives, include dispersing agents, and additional retention agents. Furthermore, any of the synthetic resins known to increase the rate of sizing or otherwise improve sizing formulations may also be added, if desired.

In the preferred embodiment, the emulsions of this invention preferably contain an anionic dispersing agent. Suitable anionic agents are described in U.S. Pat. No. 3,223,544 which discloses the use of many common and advantageous dispersing agents, the disclosure of which is hereby incorporated by reference. Preferred anionic dispersing agents include lignosulfonates, polynaphthalene sulfonates and styrene sulfonate-containing polymers.

The amount of anionic dispersing agent employed is a function of the purity of the sizing agent, specific type of starch and degree of cationicity, and specific dispersing agent used. With some sizing agents, such as impure alkyl ketene dimers, no anionic dispersing agent may be required. Generally, the anionic dispersing agent will be used in an amount of up to 0.15% by weight.

According to another feature of the invention there is provided a process for preparing the new sizing composition, said process being characterized by dissolving said highly branched, high molecular weight starch in water, if necessary by the addition of heat and by the incorporation of a dispersing agent therein; adjusting the temperature of the resulting solution to a temperature above the melting point of the cellulose-reactive sizing agent and then adding said sizing agent to the solution so as to form a coarse emulsion; subjecting said coarse emulsion to shear forces so as to reduce the particle size of the emulsion; and if necessary, cooling the emulsions thus obtained.

In connection with the dissolution of the cationic starch in water, it should be added that the upper limit of the starch concentration is in practice dictated by the handleability of the starch solution, as high starch concentrations give high viscosities.

The coarse emulsion obtained can be subjected to shear forces by means of a disperser, a homogeniser or the like in accordance with known principles. If this operation is performed at a temperature above ambient temperature, e.g. when emulsifying solid cellulose-reactive sizing agents such as ketene dimers having saturated alkyl chains, the emulsion is thereafter cooled to room temperature. Optionally pH is adjusted and/or a biocide or a synthetic resin is added as is common in the art, which operations can be made at any stage of the process.

According to still another feature of the invention, there is provided a method of preparing sized paper or paperboard where a sizing agent is added during the manufacture of the paper or paperboard, the addition being made either to the paper stock before dewatering the same or to the size press through which the paper or paperboard is passed. The method of the invention is characterized by using as the sizing agent any of the sizing compositions as herein described and is particularly advantageous for use with paper stocks with added optical brighteners such as stilbene disulfonic acids.

Preferably the novel sizing agent according to the invention is added to the paper stock before said stock is dewatered. The exact point of addition of the sizing composition is not critical, but according to an advantageous embodiment of the invention the sizing composition is added less than 5 minutes before the paper stock is dewatered.

The amount of sizing composition required varies from case to case depending on the type of pulp utilized and the final degree of hydrophobicity desired, but generally the amount, calculated as the total solids content, is from about 0.4 kg per metric ton of paper or paperboard to about 4 kg per metric ton of paper or paperboard.

In addition to the advantages of the invention which have been discussed above or will be described in the Examples, it has also quite unexpectedly been found that among starches having the degrees of substitution within the scope of the invention, those having a major proportion, or as high a proportion as possible, of amylopectin will give more stable dispersions.

The invention will now be further described by the following non-limiting examples, wherein the percentages or amounts are by weight unless stated otherwise.

Example 1

An alkylketene dimer based sizing emulsion is prepared by the addition of 125 parts of cationic starch to 2500 parts of water followed by heating the mixture formed for a period sufficient to obtain a clear, high viscous starch solution. To this mixture there are added 20 parts of an anionic dispersing agent (styrene sulfonate-containing polymer) and 500 parts alkylketene dimer prepared from a mixture of stearic acid (60%), palmitic acid (35%) and myristic acid (5%), i.e. $R_6$ is a linear saturated hydrocarbon radical containing 12–16 carbon atoms in the following distribution: 16 carbon atoms (60%); 14 carbon atoms (35%); 12 carbon atoms (5%). The mixture is then stirred until all alkylketene dimer is molten. The coarse emulsion obtained is then passed through a high pressure homogenizer at a pressure of 200 bars and is cooled to room temperature and diluted to a final ketene dimer concentration of 10%. The sizing emulsion thus formed is a milky liquid having a low viscosity.

Four different types of starches were evaluated as emulsifying agents/fixing agents in the manufacture of the sizing agents described above. The sizing effects of the dispersions obtained were tested by adding the dispersions to a diluted pulp suspension (containing 100% of bleached birch sulphate pulp) which was then used in a laboratory sheet former for the manufacture of paper sheets having a grammage of 65 g/m$^2$. After pressing the paper sheets for 5 minutes at 3 bars and drying for 10 minutes at 90° C. the sizing thus obtained was evaluated by measurements in a so called ink penetration tester where the degree of hydrophobicity is characterized by the time dependent reduction of reflectance of the front side of a paper sheet following contact of the rear side of the paper with ink. A weakly sized paper thus very rapidly loses its reflectance value while the front side of a well sized paper retains its reflectance for a longer period of time. The results of the evaluations are presented in the following table:

| | Type of Starch | % of Amylopectin in the Starch | Degree of Substitution | Added Amount, kg AKD*/ton of Paper | % Reflectance (10 min. of Contact Time | Stability |
|---|---|---|---|---|---|---|
| A. | EMPRESOL D9 | <80% | 0.085 | 0.30 | 20 | Unstable, |
| | (Emsland | | | 0.40 | 20 | (separates within |
| | Chemie) | | | 0.45 | 20 | weeks) |
| B. | HEBO 260 | 99% | 0.023 | 0.30 | 20 | Stable for at |
| | (Amaizo) | | | 0.40 | 84 | least 3 months |
| | | | | 0.45 | 92 | (23°C.) |
| C. | F 2610 | 99% | 0.072 | 0.30 | 78 | Stable for at |
| | (Emsland | | | 0.40 | 89 | least 3 months |
| | Chemie) | | | 0.45 | 94 | (23°C.) |
| D. | Commercial | | | 0.30 | 20 | Stable for at |
| | neutral | | | 0.40 | 83 | least 3 months |
| | sizing agent** | | | 0.45 | 89 | |

*AKD means alkyl ketene dimer.
**Aquapel$^{TM}$225 (Hercules), containing 10% AKD wax, stabilized with cationic starch.

Example 2

On a fine paper machine a commercial sizing agent according to Example 1 D is utilized. The degree of hydrophobicity of the resulting paper, expressed as $COBB_{60}$, varied within the range of 22–26 g/m$^2$. The commercial sizing agent was then replaced by a sizing agent according to Example 1 C, which was dosed at the same concentration as the previously used product. The result of the replacement was a gradually reduced $COBB_{60}$ value which stabilized after one hour at about 15 g/m$^2$.

Comparative Example 1

On a fine paper machine a commercial AKD-based neutral sizing agent according to Example 1 D was dosed at a concentration of 850 g of alkyl ketene dimer per ton of produced paper. The degree of sizing, expressed as $COBB_{60}$, was measured at about 25 g/m$^2$. The dosage was then reduced to 750 g of alkyl ketene dimer per ton of produced paper. The hydrophobicity of the paper was then gradually reduced and finally reached a level that is unacceptable from a quality point of view ($COBB_{60} > 30$ g/m$^2$).

Example 3

A sizing agent according to Example 1 C was dosed on a fine paper machine at a concentration of 850 g of alkyl ketene dimer per ton of produced paper. The degree of sizing, expressed as $COBB_{60}$, varied within the range of 20–25 g/m$^2$ The dosing of the sizing agent was reduced to 640 g of alkyl ketene dimer per ton of produced paper without any reduction of the degree of sizing. The measured $COBB_{60}$-values varied within the range of 20–25 g/m$^2$

Comparative Example 2

A sizing agent according to Example 1 A was dosed on a fine paper machine at a concentration of 850 g of alkyl ketene dimer per ton of produced paper. The degree of sizing, expressed as $COBB_{60}$, measured about 25 g/m$^2$. The toner adhesion, i.e. the ability of the paper to adhere the toner ink used in Xerox(R) photocopier machines, was found inferior to the adhesion obtained for paper sized with a sizing agent according to Example 1 C.

Example 4

A commercial AKD-based sizing agent according to Example 1 D was dosed on a fine paper machine at a concentration corresponding to 850 g of alkyl ketene dimer per ton of produced paper. The toner adhesion of the paper, i.e. the ability of the paper to adhere the toner ink, was measured and recorded.

The commercial sizing agent was then replaced by a sizing emulsion according to Example 1 C, which was dosed at a concentration corresponding to 640 g of alkyl ketene dimer per ton of produced paper. The toner adhesion was again measured and registered and was found to be superior to the adhesion obtained for the commercial sizing agent.

Thus, this example shows that the new sizing emulsion according to the invention can be utilized to obtain better printing and copying characteristics of the paper, i.e. an improved adhesion of toner ink at photocopying.

Example 5

A commercial AKD-based sizing agent according to Example 1 D was dosed on a fine paper machine at a concentration corresponding to 850 g of alkyl ketene dimer per ton of produced paper. The required consumption of optical brightener (anionic-self fixing) to obtain a specified degree of whiteness was continuously measured. The commercial sizing agent was then replaced by a sizing emulsion according to Example 1 C and said sizing agent was dosed at a concentration corresponding to 640 g of ketene dimer per ton of produced paper. The consumption of optical brightener was found to be reduced by 20% without any detectable loss of paper whiteness. The degree of sizing, expressed as $COBB_{60}$, was still stable and varied within the range of 20–25 g/m$^2$.

What is claimed is:

1. A sizing composition in the form of an aqueous emulsion comprising a hydrophobic cellulose-reactive sizing agent and a cationic polymer comprising a starch, characterized in that the starch possesses a combination of (A) an amylopectin content of at least 85% and (B) a degree of substitution of about 0.045 to 0.40.

2. A sizing composition according to claim 1 characterized in that the amylopectin content is about 90 to 100%.

3. A sizing composition according to claim 2, characterized in that the amylopectin content is about 98.0 to 100%.

4. A sizing composition according to claim 3, characterized in that the starch is waxy maize starch.

5. A sizing composition according to claim 1, characterized in that said degree of substitution is within the range of about 0.05 to 0.20.

6. A sizing composition according to claim 5, characterized in that the degree of substitution is about 0.05 to 0.10.

7. A sizing composition according to claim 1, characterized in that the ratio cellulose-reactive sizing agent:cationic polymer comprising a starch is within the range of about 1:0.02 to 1:2.

8. A sizing composition according to claim 7, characterized in that the ratio is about 1:0.05–0.5.

9. A sizing composition according to claim 1, characterized in that the hydrophobic cellulose-reactive sizing agent is selected from the group consisting of:

(a) acid anhydrides of the formula:

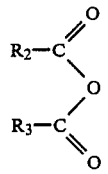

where $R_2$ and $R_3$ are the same or different and each represent hydrocarbon radicals containing 7–30 carbon (b) cyclic dicarboxylic anhydrides of the formula:

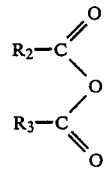

where $R_4$ contains 2 or 3 carbon atoms and $R_{56}$ is a hydrocarbon radical having 7–30 carbon atoms;

(c) ketene dimers of the formula:

$(R_6CH{=}C{=}O)_2$ where $R_6$ is a hydrocarbon radical having 6–30 carbon atoms; and (d) isocyanates of the formula $R_7{-}N{=}C{=}O$ where $R_7$ is a hydrocarbon radical having 7–30 carbon

10. A sizing composition according to claim 9, characterized in that the hydrophobic cellulose-reactive sizing agent is a ketene dimer of the formula:

$(R_6CH{=}C{=}O)_2$ where $R_6$ is a hydrocarbon radical having 6–30 carbon

11. A sizing composition according to claim 1, characterized in that it further contains a dispersing agent and/or an additional synthetic resin.

* * * * *

UNITED STATES PATENT AND TRADEMARK OFFICE

CERTIFICATE OF CORRECTION

PATENT NO. : 4,964,915

DATED : October 23, 1990

INVENTOR(S) : Blixt et al

It is certified that error appears in the above-identified patent and that said Letters Patent is hereby corrected as shown below:

In the Claims:

In Claim 9, line 13, after the word "carbon" insert --atoms--, in line 16-24 delete the formula:

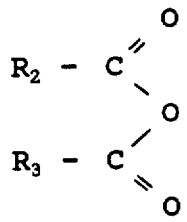

and insert therefor the formula:

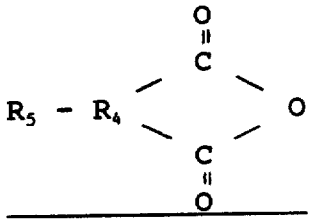

in line 26, delete the term "$R_{56}$" and insert therefor --$R_5$--, and in line 46, after the word "carbon" insert --atoms--.

UNITED STATES PATENT AND TRADEMARK OFFICE

CERTIFICATE OF CORRECTION

PATENT NO. : 4,964,915

DATED : October 23, 1990

INVENTOR(S) : Blixt et al

It is certified that error appears in the above-identified patent and that said Letters Patent is hereby corrected as shown below:

In Claim 10, line 5, after the word "carbon" insert --atoms--.

Signed and Sealed this

Seventh Day of January, 1992

*Attest:*

HARRY F. MANBECK, JR.

*Attesting Officer*

*Commissioner of Patents and Trademarks*